US009276340B2

(12) United States Patent
Amini et al.

(10) Patent No.: US 9,276,340 B2
(45) Date of Patent: Mar. 1, 2016

(54) INTERPOSERS FOR CONNECTING RECEPTACLE TONGUES TO PRINTED CIRCUIT BOARDS

(71) Applicant: Apple Inc., Cupertino, CA (US)

(72) Inventors: Mahmoud R. Amini, Sunnyvale, CA (US); Zheng Gao, San Jose, CA (US); Nathan N. Ng, Fremont, CA (US); Jason Hwang Lee, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/543,768

(22) Filed: Nov. 17, 2014

(65) Prior Publication Data

US 2015/0340782 A1 Nov. 26, 2015

Related U.S. Application Data

(60) Provisional application No. 62/003,022, filed on May 26, 2014.

(51) Int. Cl.

| | |
|---|---|
| ***H01R 12/00*** | (2006.01) |
| ***H01R 12/71*** | (2011.01) |
| ***H01R 24/66*** | (2011.01) |
| ***H01R 13/24*** | (2006.01) |

(52) U.S. Cl.
CPC ..... *H01R 12/71* (2013.01); *H01R 13/2414* (2013.01); *H01R 24/66* (2013.01)

(58) Field of Classification Search
CPC . H01R 9/096; H01R 13/2414; H01R 13/2435
USPC ..... 439/66
See application file for complete search history.

(56) References Cited

U.S. PATENT DOCUMENTS

| | | | |
|---|---|---|---|
| 3,128,138 | A | 4/1964 | Noschese |
| 3,587,029 | A | 6/1971 | Knowles |
| 4,337,989 | A | 7/1982 | Asick et al. |
| 4,389,080 | A | 6/1983 | Clark et al. |

(Continued)

FOREIGN PATENT DOCUMENTS

| | | |
|---|---|---|
| EP | 1 085 604 A2 | 3/2001 |
| EP | 2 228 871 A2 | 9/2010 |

(Continued)

OTHER PUBLICATIONS

International Search Report and Written Opinion of the International Seaching Authority mailed on Mar. 17, 2015 for PCT Patent Application No. PCT/US2015/010253, 12 pages.

(Continued)

*Primary Examiner* — Chandrika Prasad
(74) *Attorney, Agent, or Firm* — Kilpatrick Townsend & Stockton LLP

(57) ABSTRACT

Connecting structures to mechanically connect to a connector receptacle tongue and a printed circuit board and to electrically connect contacts on the connector receptacle tongue to traces on the printed circuit board. One example may provide an interposer having a housing and a plurality of contacts. The contacts may have a side or tongue connecting portion extending beyond a side of the housing and a bottom or board contacting portion extending beyond a bottom of the housing. The contacts may form a ninety-degree bend. A shield may at least substantially surround a top and the other three sides of the housing.

19 Claims, 16 Drawing Sheets

(56) References Cited

U.S. PATENT DOCUMENTS

| | | | | |
|---|---|---|---|---|
| 4,544,227 | A | 10/1985 | Hirose | |
| 4,684,192 | A | 8/1987 | Long et al. | |
| 4,808,118 | A | 2/1989 | Wilson et al. | |
| 4,875,881 | A | 10/1989 | Caveny et al. | |
| 4,950,184 | A | 8/1990 | Caveney et al. | |
| 5,145,385 | A | 9/1992 | Takano | |
| 5,382,179 | A | 1/1995 | Noschese | |
| 5,431,578 | A | 7/1995 | Wayne | |
| 5,586,911 | A | 12/1996 | Miller | |
| 5,591,050 | A | 1/1997 | Sueoka | |
| 5,622,522 | A | 4/1997 | Tan et al. | |
| 5,788,516 | A * | 8/1998 | Uggmark | H01R 13/2414 439/63 |
| 5,913,690 | A | 6/1999 | Dechelette et al. | |
| 5,975,935 | A | 11/1999 | Yamaguchi et al. | |
| 5,997,349 | A | 12/1999 | Yoshioka | |
| 6,019,616 | A | 2/2000 | Yagi et al. | |
| 6,039,583 | A | 3/2000 | Korsunsky et al. | |
| 6,042,424 | A | 3/2000 | LaCoy et al. | |
| 6,287,147 | B1 | 9/2001 | Lin | |
| 6,338,652 | B1 | 1/2002 | Ko | |
| 6,565,366 | B1 | 5/2003 | Wu | |
| 7,179,124 | B2 | 2/2007 | Zhang et al. | |
| 7,462,071 | B1 | 12/2008 | Wu | |
| 7,658,617 | B1 * | 2/2010 | Brodsky | H05K 7/1069 439/66 |
| 7,670,156 | B2 | 3/2010 | Chen | |
| 7,837,506 | B1 | 11/2010 | Chiang | |
| 8,011,948 | B2 | 9/2011 | Wu | |
| 8,133,061 | B1 * | 3/2012 | Ayers, Sr. | H01R 12/714 439/66 |
| 8,147,272 | B2 | 4/2012 | Rhein | |
| 8,454,381 | B2 | 6/2013 | Wu | |
| 8,545,273 | B1 | 10/2013 | Chen | |
| 8,567,050 | B2 | 10/2013 | Hiew et al. | |
| 8,708,752 | B2 | 4/2014 | Wu | |
| 8,808,029 | B2 | 8/2014 | Castillo et al. | |
| 8,821,181 | B1 | 9/2014 | Lam et al. | |
| 8,992,249 | B2 | 3/2015 | Kobayashi et al. | |
| 2002/0001982 | A1 | 1/2002 | Sakurada | |
| 2002/0142636 | A1 | 10/2002 | Murr et al. | |
| 2005/0026469 | A1 | 2/2005 | Ice et al. | |
| 2007/0115682 | A1 | 5/2007 | Roberts et al. | |
| 2007/0254517 | A1 | 11/2007 | Olson et al. | |
| 2009/0023339 | A1 | 1/2009 | Kameyama et al. | |
| 2009/0042448 | A1 | 2/2009 | He et al. | |
| 2010/0248544 | A1 | 9/2010 | Xu et al. | |
| 2010/0303421 | A1 | 12/2010 | He et al. | |
| 2011/0151688 | A1 * | 6/2011 | Beaman | H01R 13/2407 439/66 |
| 2011/0237134 | A1 * | 9/2011 | Gao | H01R 13/6271 439/660 |
| 2011/0300749 | A1 | 12/2011 | Sytsma et al. | |
| 2012/0282808 | A1 | 11/2012 | Luo | |
| 2013/0122752 | A1 | 5/2013 | Lu | |
| 2013/0183862 | A1 | 7/2013 | Ni et al. | |
| 2013/0288520 | A1 | 10/2013 | Simmel | |
| 2013/0288537 | A1 | 10/2013 | Simmel | |
| 2013/0330976 | A1 | 12/2013 | Simmel | |
| 2014/0073183 | A1 | 3/2014 | Golko | |
| 2014/0113493 | A1 | 4/2014 | Funamura | |
| 2014/0194005 | A1 | 7/2014 | Little | |
| 2014/0220827 | A1 | 8/2014 | Hsu | |
| 2015/0031240 | A1 | 1/2015 | Yang | |
| 2015/0162684 | A1 | 6/2015 | Amini et al. | |
| 2015/0171562 | A1 | 6/2015 | Gao et al. | |
| 2015/0200493 | A1 * | 7/2015 | Gao | H01R 13/6582 439/607.28 |

FOREIGN PATENT DOCUMENTS

| | | | |
|---|---|---|---|
| EP | 2 590 273 | A2 | 5/2013 |
| GB | 2 067 361 | A | 7/1981 |
| WO | 2011/163256 | A1 | 12/2011 |
| WO | 2012/177905 | A2 | 12/2012 |

OTHER PUBLICATIONS

Invitation to Pay Additional Fees and, Where Applicable, Protest Fee with Partial International Search Report mailed on Apr. 28, 2015 for PCT Patent Application No. PCT/US2014/065968, 6 pages.

Invitation to Pay Additional Fees and, Where Applicable, Protest Fee with Partial International Search Report mailed on May 4, 2015 for PCT Patent Application No. PCT/US2014/065996, 7 pages.

International Search Report and Written Opinion of the International Seaching Authority mailed on Jul. 3, 2015 for PCT Patent Application No. PCT/US2014/065968, 17 pages.

International Search Report and Written Opinion of the International Seaching Authority mailed on Jul. 10, 2015 for PCT Patent Application No. PCT/US2014/065996, 18 pages.

Office Action mailed on Nov. 10, 2015 for U.S. Appl. No. 14/543,717, 16 pages.

Office Action mailed on Nov. 17, 2015 for U.S. Appl. No. 14/543,748, 21 pages.

Office Action mailed on Dec. 9, 2015 for U.S. Appl. No. 14/543,711, 15 pages.

Office Action mailed on Jan. 4, 2016 for U.S. Appl. No. 14/543,803, 14 pages.

* cited by examiner

INTERPOSERS FOR CONNECTING RECEPTACLE TONGUES TO PRINTED CIRCUIT BOARDS

CROSS-REFERENCES TO RELATED APPLICATIONS

This application claims the benefit of U.S. provisional patent application No. 62/003,022, filed May 26, 2014, which is incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Power may be transferred with this data, or power may be transferred separately.

Power and data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices to form pathways for power and data.

These receptacles may include a tongue supporting a number of contacts. The contacts may be electrically connected to traces on the tongue. The traces on the tongue may electrically connect to traces on a printed circuit board or other substrate in the electronic device. Often this may be accomplished by mounting the connector receptacle on the printed circuit board.

But in some devices it may be desirable to locate a receptacle such that its tongue is located at a different height or Z position from the printed circuit board in the electronic device. For example, it may be desirable to position a receptacle at a mid-height level of an electronic device while it may be desirable to locate a board at a lower-height level of the electronic device. It may also be desirable to be able to rotate a position of a connector receptacle relative to a printed circuit board in the electronic device.

Thus, what is needed are interposers and other connecting structures for electrically connecting contacts on a connector receptacle tongue to traces on a printed circuit board.

SUMMARY

Accordingly, embodiments of the present invention may provide interposers and other connecting structures for electrically connecting contacts on a connector receptacle tongue to traces on a printed circuit board where the connector receptacle are at different heights or Z positions or at different angles relative to each other.

Embodiments of the present invention may provide electronic devices that may include one or more connector receptacles. These connector receptacles may each include a tongue supporting a number of contacts. These contacts may electrically connect to traces on or in the tongue. The electronic devices may each have a printed circuit board or other substrate, which may support a number of circuits or components joined by one or more traces. The receptacle tongue and printed circuit board may be at different heights or Z positions in an electronic device and may be formed as separate structures for this reason. In other embodiments the present invention, a tongue may be rotated relative to the printed circuit board. In still other embodiments of the present invention, a tongue and printed circuit board may be separate structures for other reasons. In these situations, embodiments of the present invention may provide an interposer or other connecting structure to connect the receptacle tongue to the printed circuit board. These interposers may provide height or angle translation functions such that a tongue of a receptacle may be connected to a main logic, motherboard, or other appropriate board or substrate.

An illustrative embodiment of the present invention may provide an interposer having a number of through-hole contacts in a housing. The through-hole contacts may be inserted in openings in a tongue and printed circuit board. The amount of the through-hole contacts that are inserted may be varied in order to adjust for variations in height between the tongue and printed circuit board.

Another illustrative embodiment of the present invention may provide an interposer having a number of surface-mount contacts on a top and bottom of a housing. The surface-mount contacts may be soldered to contacts on a tongue and printed circuit board. Surface-mount contacts on a bottom of the interposer may electrically connect to surface-mount contacts on a bottom of the interposer.

Another illustrative embodiment of the present invention may provide an interposer having a housing and a plurality of contacts. The contacts may have a side or tongue connecting portion extending beyond a first side of the housing and a bottom or board contacting portion extending beyond a bottom of the housing. The contacts may form a ninety-degree bend. A shield may at least substantially surround a top, first side, second side, and third side of the housing.

Another illustrative embodiment of the present invention may provide an interconnect structure. The interconnect structure may include a first housing portion forming a tongue for a connector receptacle. A second housing portion may support a first plurality of contacts. The first plurality of contacts may each include at least one tongue contacting portion at a first end to form a contact on a first side of the tongue and a board contacting portion at a second end. A third housing portion may support a second plurality of contacts and the second plurality of contacts may each include at least one tongue contacting portion at a first end to form a contact on a second side of the tongue and a board contacting portion at a second end. The tongue contacting portions of each of the first and second plurality of contacts may be orthogonal to a corresponding board contacting portion. A shield may be formed around at least portions of the first housing, the second housing, and the third housing. At least one of the plurality of first contacts and at least one or the plurality of second contacts may each include two tongue contacting portions and one board contacting portion.

These and other embodiments of the present invention may provide interposers and other connecting structures that provide height, rotational, or both height and rotational translations. These interposers and other connecting structures may mechanically connect a tongue or other connector receptacle portion to a printed circuit board or other appropriate substrate. These interposers and other connecting structures may also electrically connect contacts or traces on the tongue to traces on the printed circuit board or other appropriate substrate.

In various embodiments of the present invention, contacts, shields, and other conductive portions of interposers and other connecting structures may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings and device enclosures, may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards and tongues used may be formed of FR-4, BT or other material. Printed circuit boards may be replaced by other substrates, such as flexible circuit boards, in many embodiments of the present invention.

Embodiments of the present invention may provide interposes and connecting structures that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These interposes and connecting structures may provide pathways for signals that are compliant with various standards such as Universal Serial Bus (USB) including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide interposes and connecting structures that may be used to provide a reduced set of functions for one or more of these standards. In various embodiments of the present invention, these interconnect paths provided by these interposes and connecting structures may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
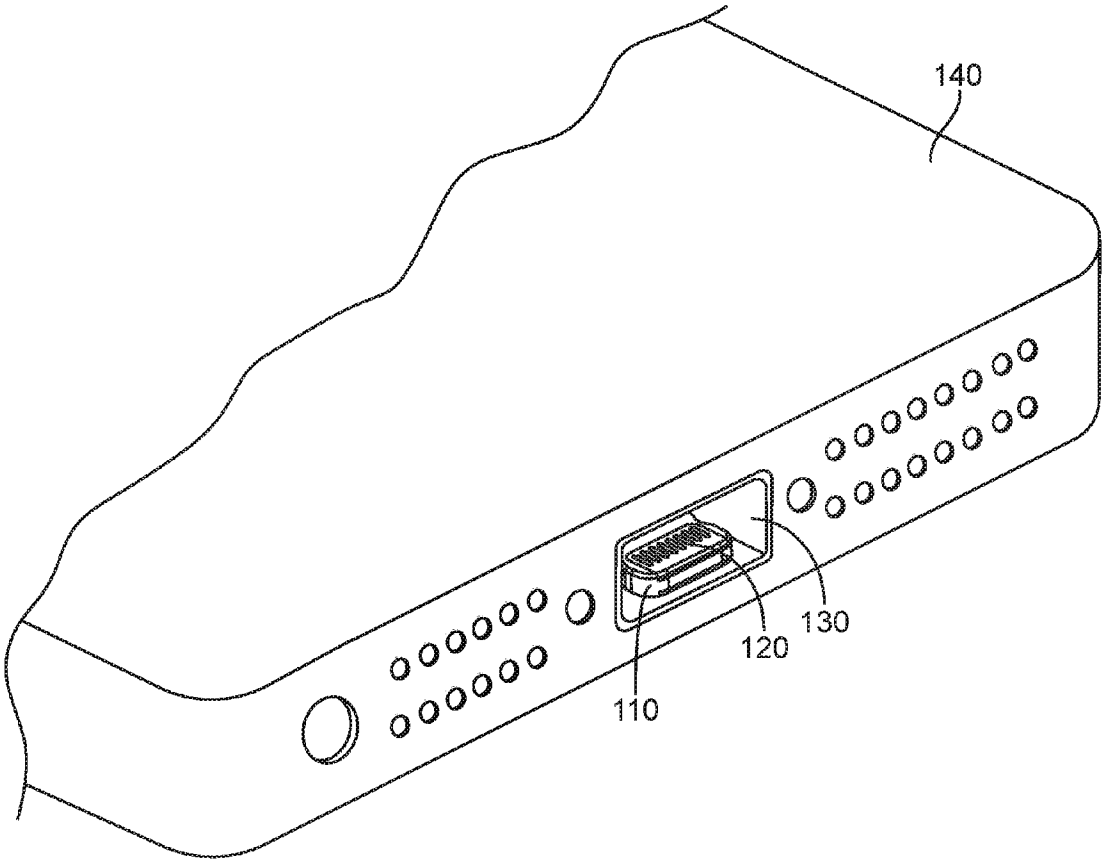
FIG. 1 illustrates an electronic device according to an embodiment of the present invention.

FIG. 1 illustrates an electronic device according to an embodiment of the present invention. This figure, as with the other included figures, is shown for illustrative purposes and does not limit either the possible embodiments of the present invention or the claims. This electronic device may be housed in device enclosure 140. Tongue 110 may be located in an opening 130 in the device enclosure 140. Contacts 120 may be located on tongue 110. Contacts 120 may electrically connect to traces on and in tongue 110. These traces may connect through an interposer or other connecting structure according to an embodiment of the present invention to traces on a printed circuit board in the electronic device.

In various embodiments of the present invention, the tongue and board may be at different heights or at angles relative to each other in an electronic device. In these situations, one or more different types of interposers may be used to connect these boards. A connector receptacle according to an embodiment of the present invention is shown in the following figure.

Figure 2:
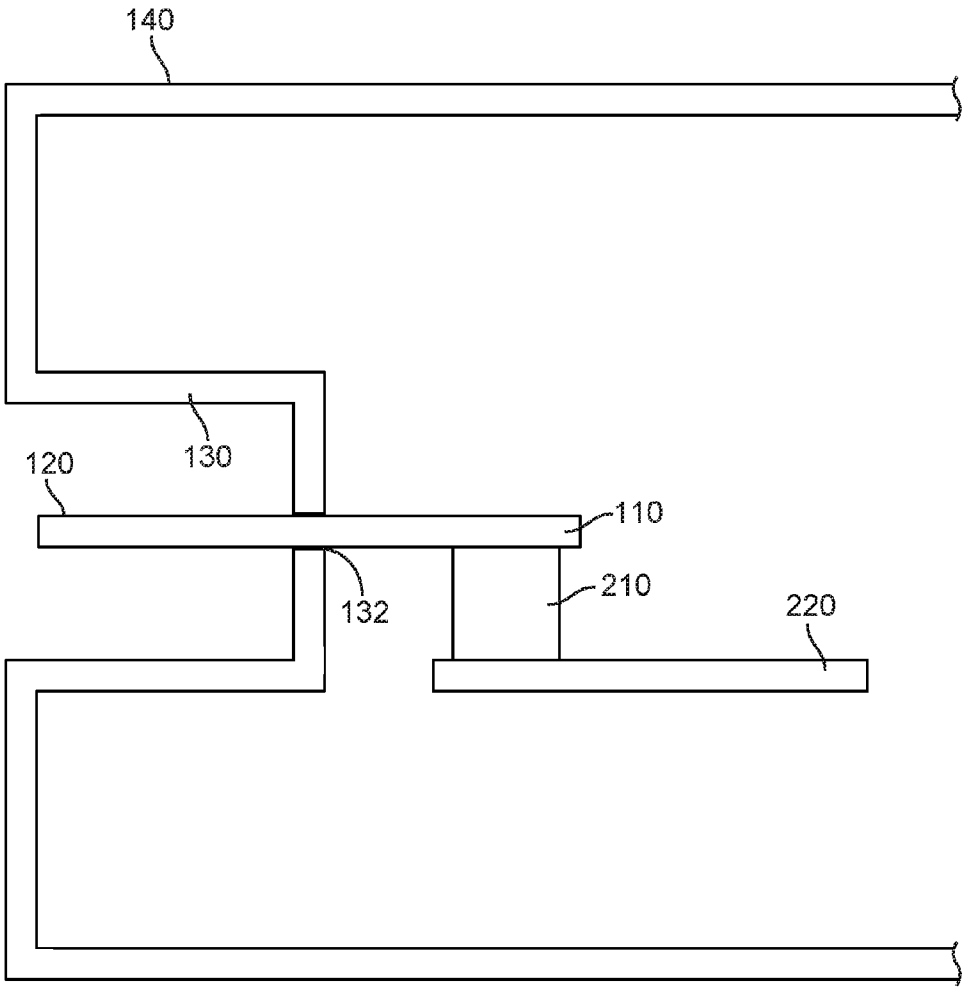
FIG. 2 illustrates a side view of an electronic device according to an embodiment of the present invention.

FIG. 2 illustrates a side view of an electronic device according to an embodiment of the present invention. In this example, tongue 110 may be located in a recess 130 in housing 140. Specifically, tongue 110 may be inserted through passage or opening 132 in recess 130 such that contacts 120 may be mated with corresponding contacts on a connector insert (not shown.) More information on these connector receptacles and tongues may be found in co-pending U.S. patent application Ser. No. 14/543,748, titled "Connector Receptacle Having a Tongue," filed Nov. 17, 2014, which is incorporated by reference.

It may be desirable to connect contacts 120, which may be connected to traces on tongue 110, to traces on printed circuit board 220. However, these to boards may be at different heights or at different angles in the device. Accordingly, interposer 210 or other connecting structure may be used to connect contacts 120 and traces on tongue 110 to traces on printed circuit board 220. Also, while embodiments of the present invention are well-suited to forming electrical connections between tongues and printed circuit boards, embodiments of the present invention may provide interposers and other interconnect structures to form electrical connections between other structures, such as receptacle housings that may support a number of contacts, flexible circuit boards, and other appropriate connector portions and substrates. Examples of specific interposers and connecting structures are shown in the following figures.

Figure 3:
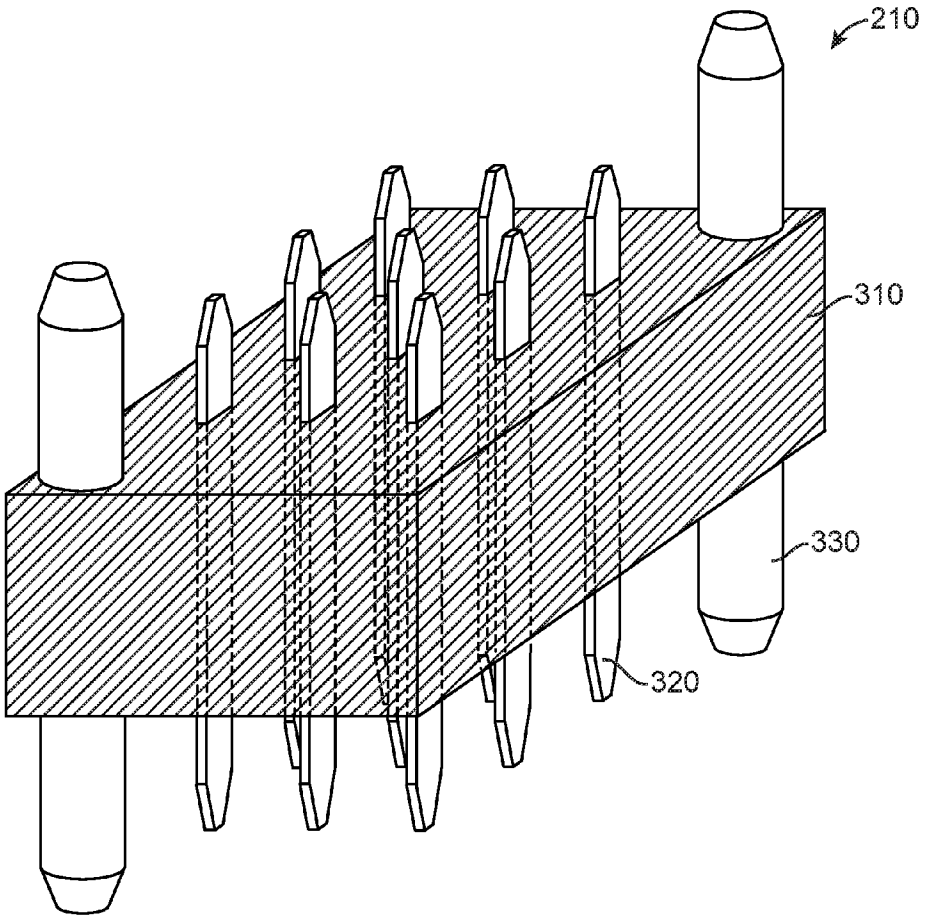
FIG. 3 illustrates an interposer according to an embodiment of the present invention.

FIG. 3 illustrates an interposer according to an embodiment of the present invention. Interposer 210 may include a number of through-hole contacts 320 housed in a housing 310. These through-hole contacts 320 may be placed in openings in a tongue and printed circuit board in an electronic device. That is, through-hole contacts 320 may fit in holes or openings on tongue 110 and board 220 in an electronic device and soldered to form electrical connections with traces connected to the holes or openings. Posts 330 may optionally be included for alignment and mechanical support. Housing 310 may be formed of plastic or other nonconductive material.

Through-hole contacts 320 may help to provide vertical adjustment to the connections between a tongue and a printed circuit board, such as tongue 110 and printed circuit board 220. That is, the contacts 320 may be inserted into openings in the tongue or printed circuit board an amount that varies with the vertical offset, or difference in Z position, between the tongue and printed circuit board. This adjustment may be useful in accounting for variations in positions when interposers are used to connect a tongue and board at different angles relative to each other.

Through-hole contacts, such as through-hole contacts 320, may tend to emit more signal noise thereby degrading signal integrity. This may make these through-hole contacts unsuitable for very high-speed applications. In such applications, surface mount contacts may be used. These surface mount contacts may be positioned on either or both ends of contacts, such as contacts 320. These surface mount contacts may be SMT type contacts, ball contacts, or other types of surface mount contacts. An example of an interposer using ball contacts is shown in the following figure.

Figure 4:
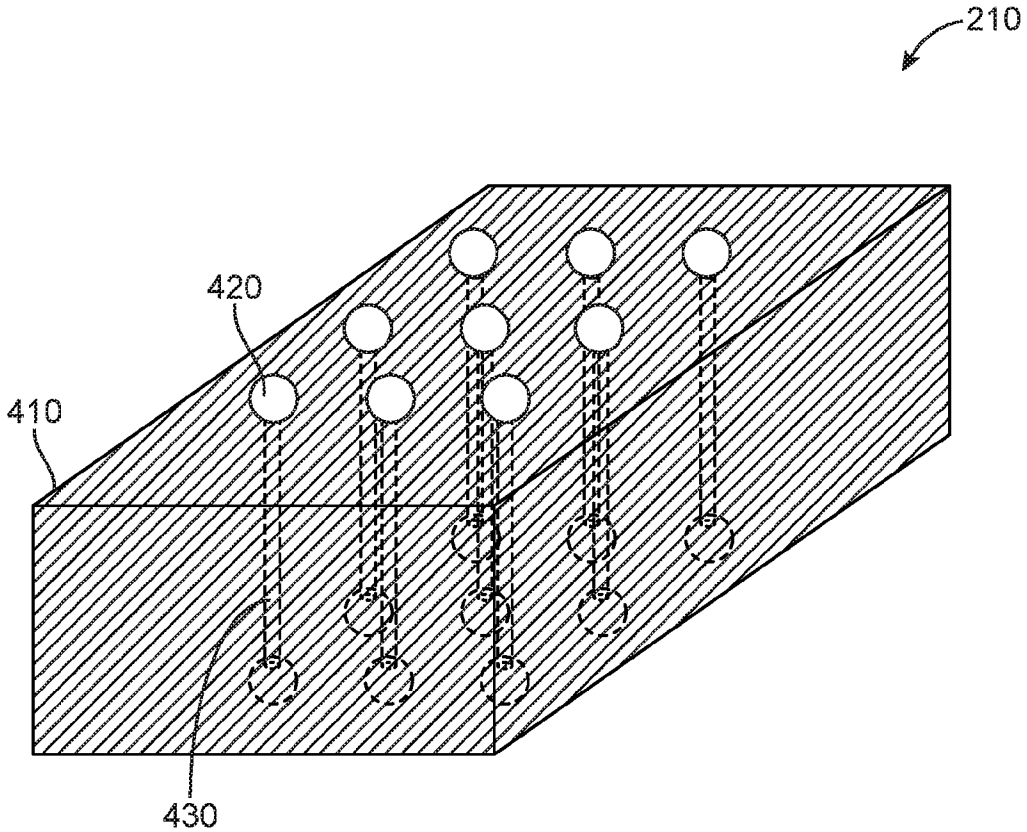
FIG. 4 illustrates another interposer according to an embodiment of the present invention.

FIG. 4 illustrates another interposer according to an embodiment of the present invention. This interposer may include ball grid array contacts 420 on a top and bottom surface of housing 410. These ball grid arrays may be interconnected by pathways 430. The ball grid array contacts may provide surface mount connections to a tongue and to a printed circuit board.

In various embodiments of the present invention, it may be desirable to attach an interposer to a tongue before attaching the interposer and tongue together as a unit to a printed circuit board. In such case, a higher temperature solder or connecting material may be used to connect the tongue to the interposer. This may ensure that the tongue and interposer remain intact together while the interposer is soldered to the printed circuit board using a lower temperature solder or connecting material.

Figure 5:
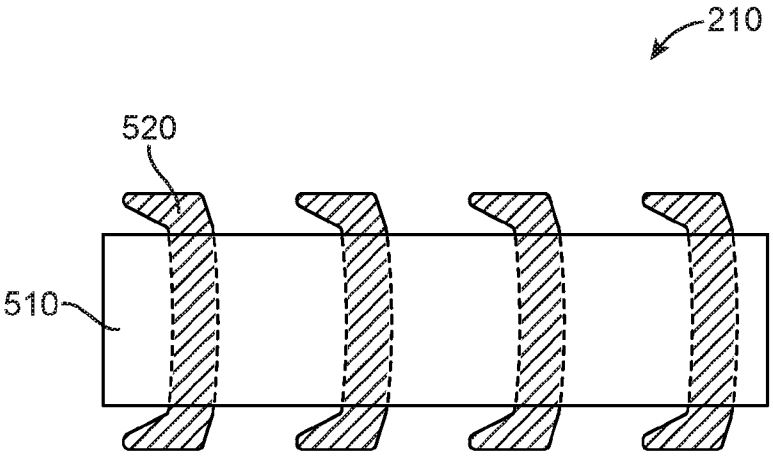
FIG. 5 illustrates another interposer according to an embodiment of the present invention.

FIG. 5 illustrates another interposer according to an embodiment of the present invention. In this example, spring contacts 520 may be located in housing 510 of interposer 210. Spring contacts 520 of interposer 210 may compress and form connections when sandwiched between a tongue and a printed circuit board, such as tongue 110 and printed circuit board 220 in the above example.

Figure 6:
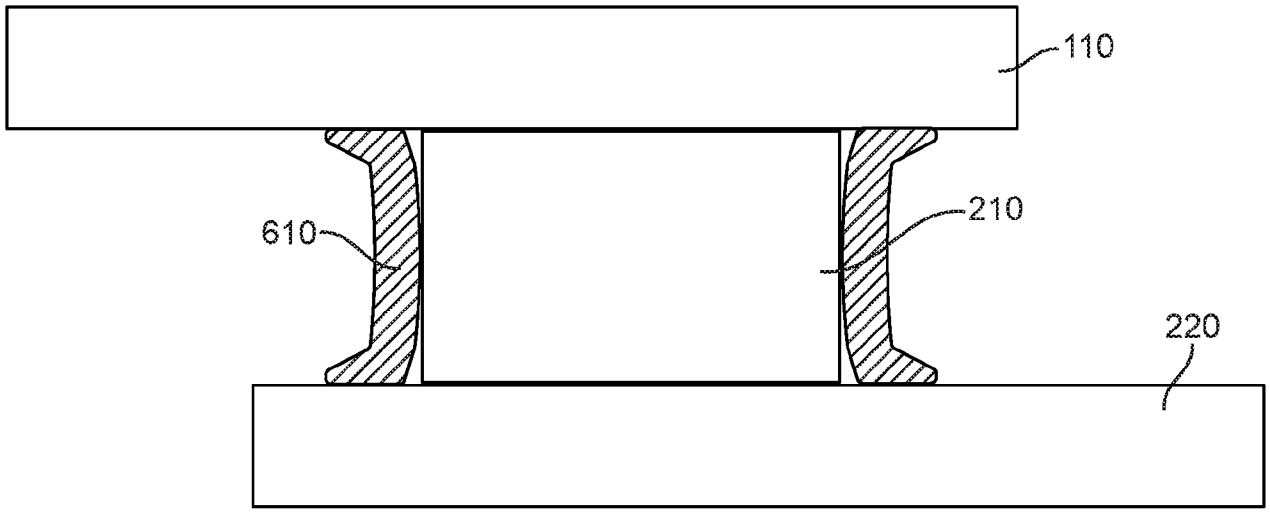
FIG. 6 illustrates a side view of an interposer having a ground shield according to an embodiment of the present invention.

FIG. 6 illustrates a side view of an interposer having a ground shield according to an embodiment of the present invention. In this example, tongue 110 may be connected to printed circuit board 220 through interposer 210. These spring finger arrangement of FIG. 5 may be used to provide ground shields 610. Interposer 210 may be formed as any of the interposers shown here, or it may be formed in other ways.

Figure 7:
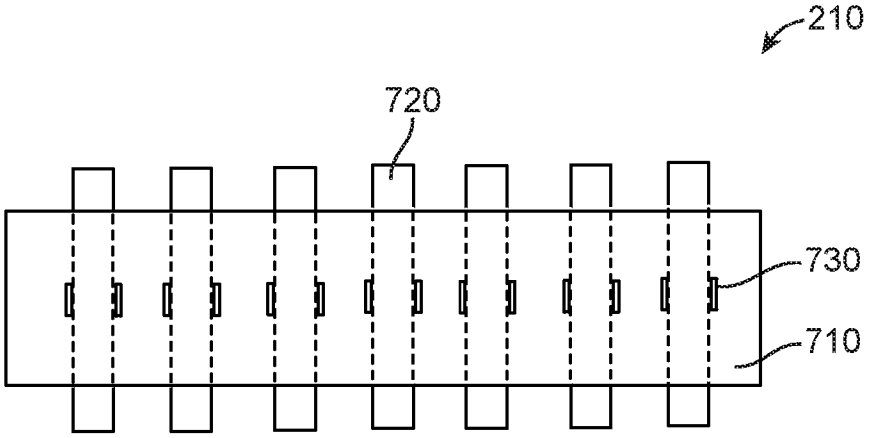
FIG. 7 illustrates another interposer according to an embodiment of the present invention.

FIG. 7 illustrates another interposer according to an embodiment of the present invention. In this embodiment of the present invention, tin bars 720 may be located in nonconductive housing 710 of interposer 210. During soldering, tin bars 4020 may flow forming connections to contacts on a tongue and printed circuit board. Crash bars 730 may be used to secure tin bars 720 in place.

In these embodiments of the present invention, the interposers may provide a height translation. In these and other embodiments of the present invention, interposers may provide an angular translation. Examples are shown in the following figures.

Figure 8:
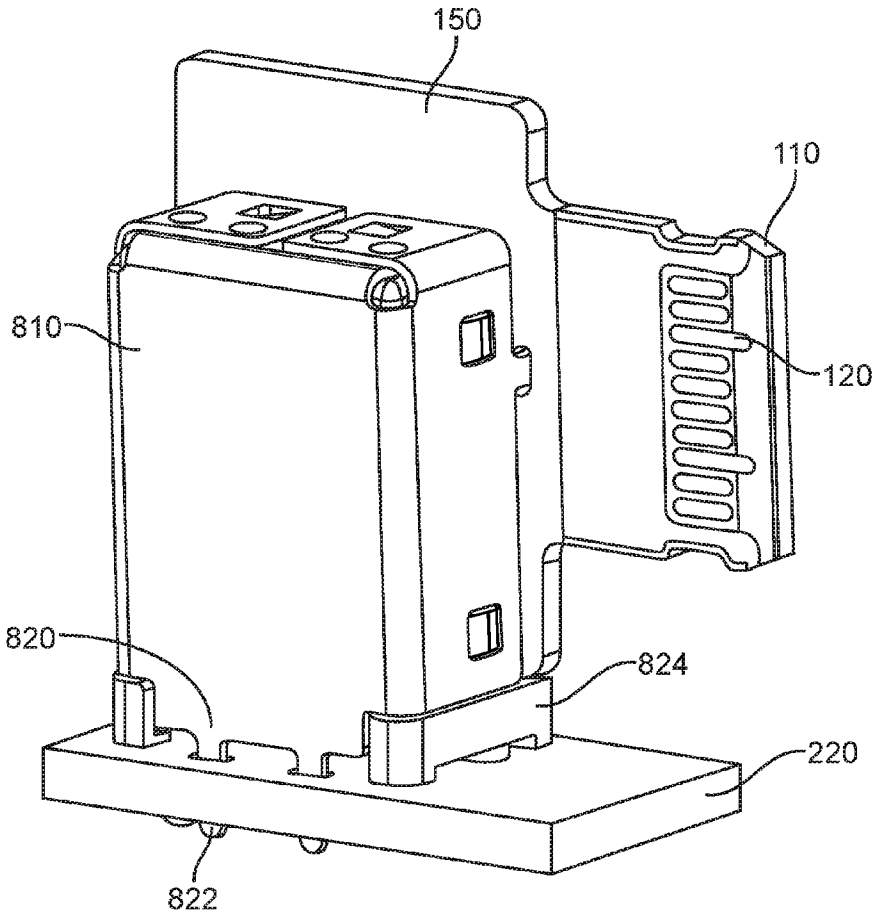
FIG. 8 illustrates an interposer according to an embodiment of the present invention.

FIG. 8 illustrates an interposer according to an embodiment of the present invention. As with the other interposers and connecting structures shown, interposer 810 may physically attach tongue 110 to printed circuit board 220 and interposer 810 may electrically connect traces on or in tongue 110 to traces on or in printed circuit board 220. In this example, tongue 110 may support contacts 120 and may have a connecting portion 150. Interposer 810 may include a shield 820 having tabs 822. Interposer 810 may be supported by support structure 824. Support structure 824 and tabs 822 may be inserted in holes in printed circuit board 220. In this way, interposer 810 may physically attach tongue 110 to printed circuit board or other appropriate substrate 220. In this example, interposer 810 may also provide a 90 degree translation, that is, tongue 110 may be at an angle relative to printed circuit board 220. Interposer 810 may electrically connect traces on or in tongue 110 to traces on or in board 220 through a plurality of contacts. An example is shown in the following figure.

Figure 9:
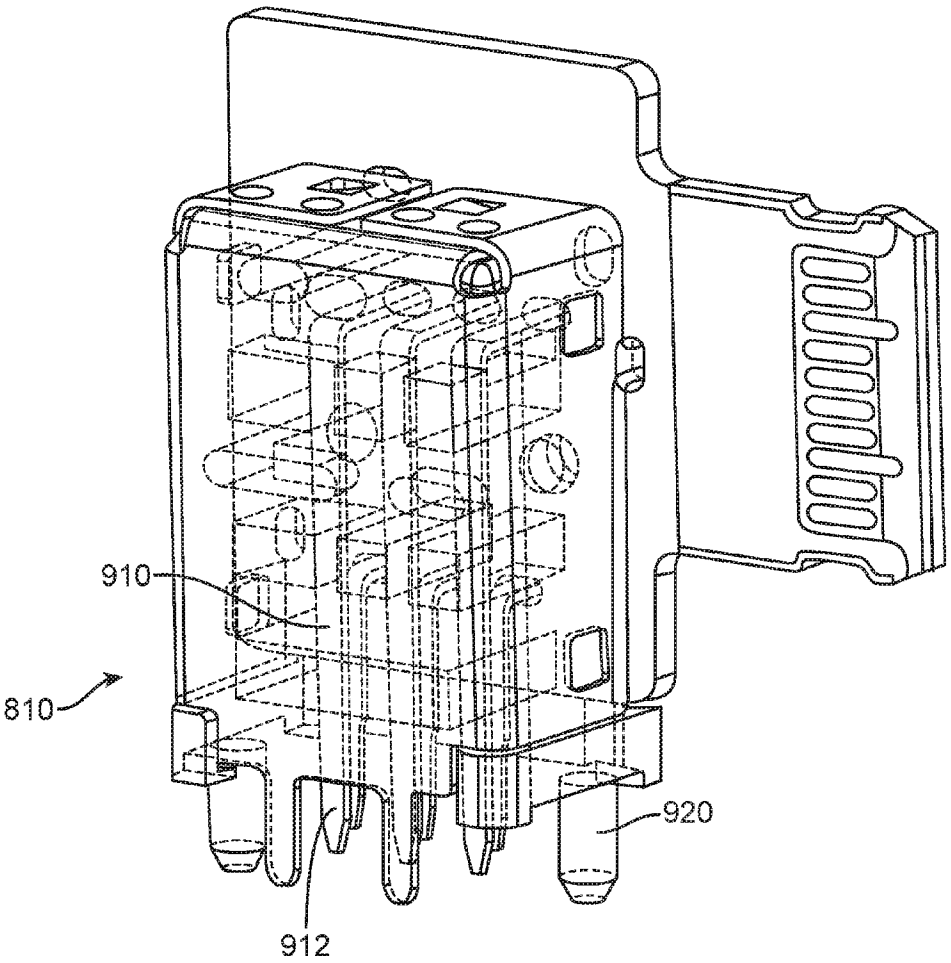
FIG. 9 illustrates a transparent view of the interposer of FIG. 8.

FIG. 9 illustrates a transparent view of the interposer of FIG. 8. In this example, contacts 910 may provide a right-angle translation between traces on a tongue and another printed circuit board. Contacts 910 may include through-hole portions 912. Posts 920 may be used for alignment purposes and mechanical support.

Figure 10:
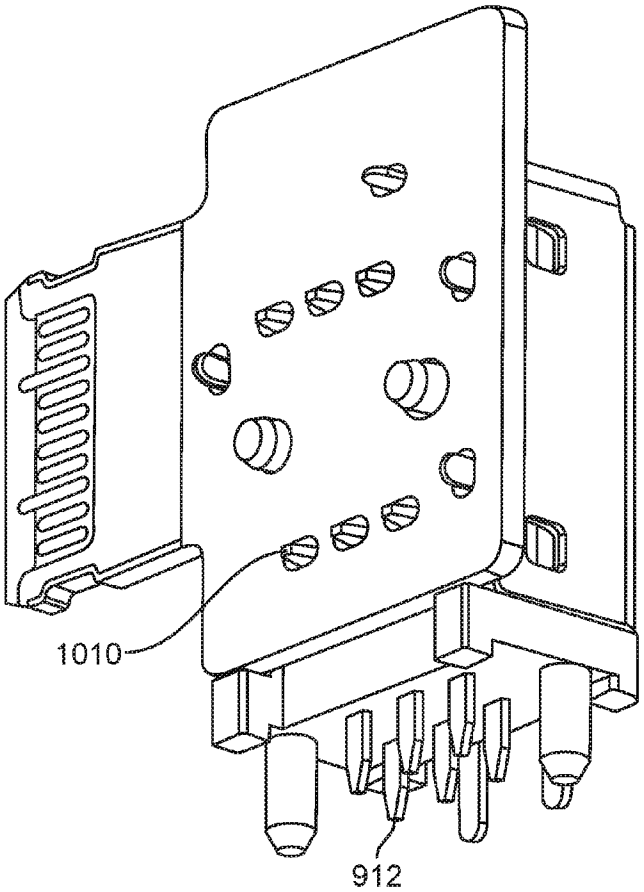
FIG. 10 illustrates a reverse side view of the interposer of FIG. 8.

FIG. 10 illustrates a reverse side view of the interposer of FIG. 8. Again, through-hole contacts 1010 and 912 may be used to join traces between a tongue and printed circuit board, such as tongue 110 and printed circuit board 220.

Figure 11:
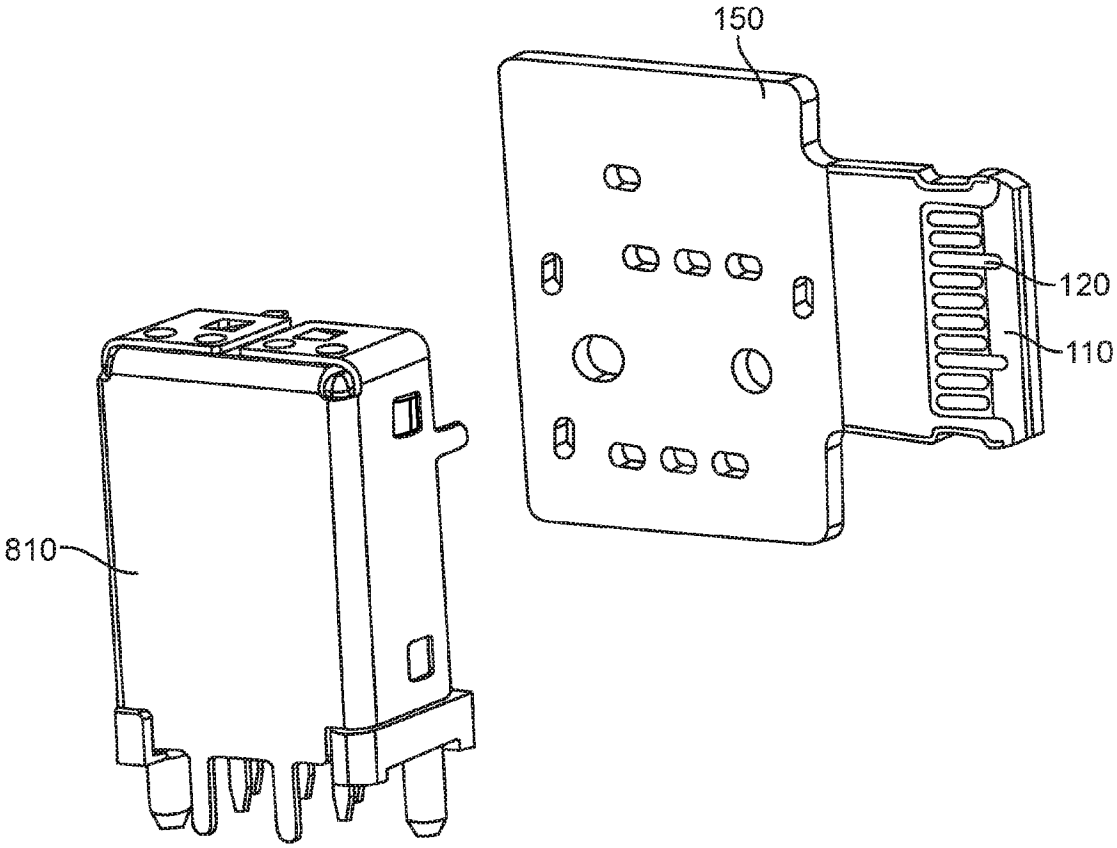
FIG. 11 illustrates an isolated view of a tongue and interposer according to an embodiment of the present invention.

FIG. 11 illustrates an isolated view of a tongue and interposer according to an embodiment of the present invention. Tongue 110 may support contacts 120 and may have a connecting portion 150. Interposer 810 may connect tongue 110 to a printed circuit board 220 (shown in other illustrations.)

Figure 12:
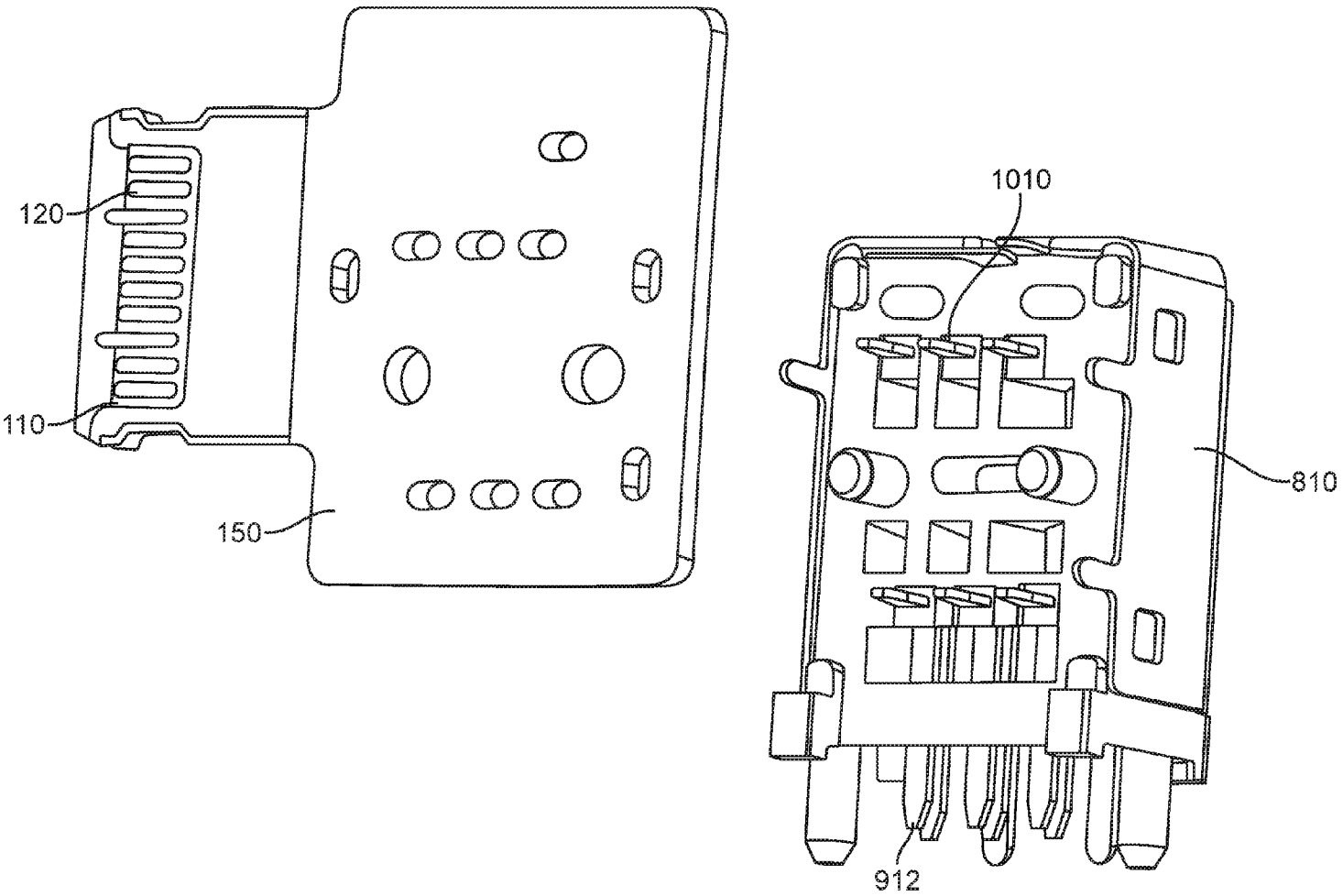
FIG. 12 illustrates another isolated view of a tongue and interposer according to an embodiment of the present invention.

FIG. 12 illustrates another isolated view of a tongue and interposer according to an embodiment of the present invention. Again, tongue 110 may support contacts 120 and may have a contacting portion 150. Interposer 810 may provide a right-angled translation using contacts having through-hole contacting portions 1010 and 912.

Figure 13:
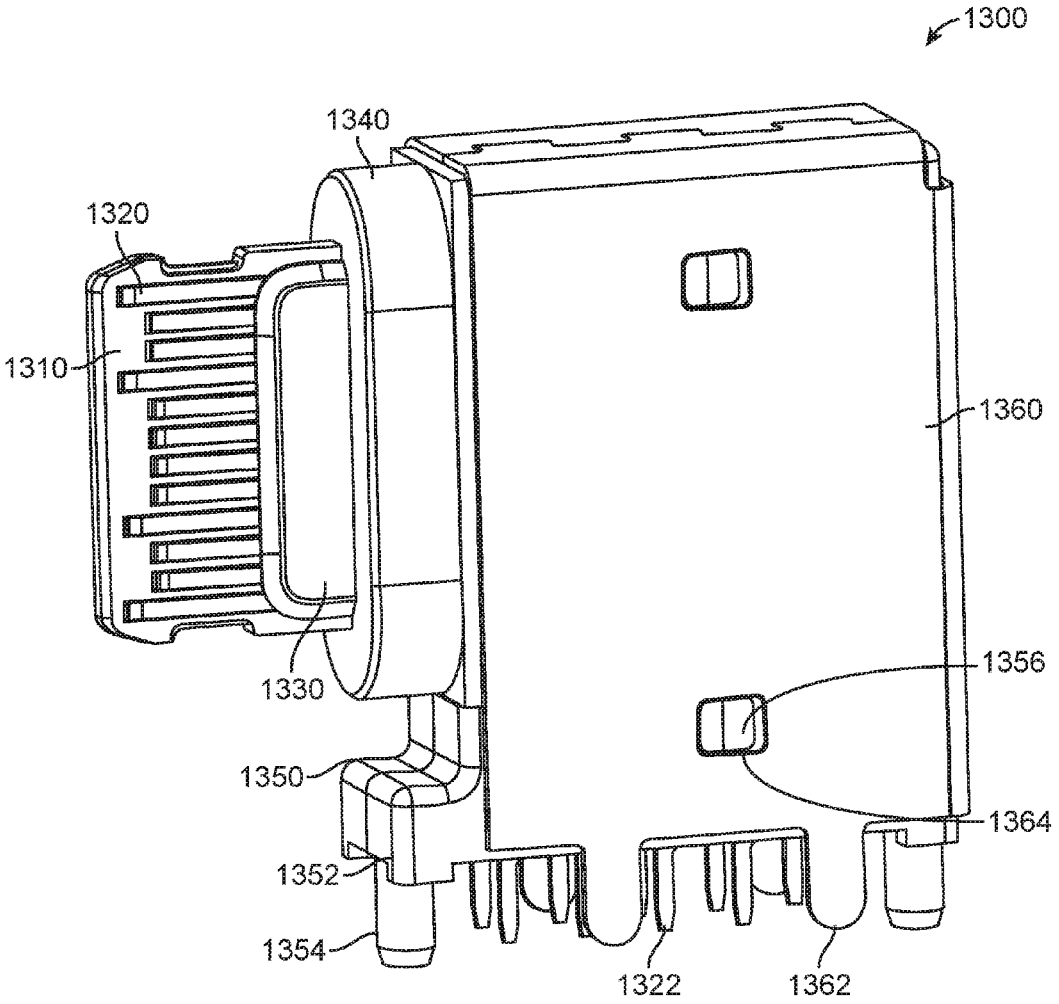
FIG. 13 illustrates another connecting structure according to an embodiment of the present invention.

FIG. 13 illustrates a connecting structure according to an embodiment of the present invention. Connecting structure 1300 may include tongue 1310 supporting a number of contacts 1320 on each side. Tongue 1310 may further include ground contacts 1330 on each side. Raised portion 1340 may be formed around tongue 1310 and may be arranged to accept an opening on a connector insert, or it may be arranged to fit in an opening in a device enclosure that may house connecting structure 1300. Contacts 1320 may terminate in board contact portions 1322. Board contact portions 1322 may fit in openings in a printed circuit board and may connect to traces in a printed circuit board. Housing portions 1350 and 1352 may support these contacts and may be at least partially surrounded by shield 1360. Shield 1360 may include opening 1364 for accepting tabs 1356 on housing portions 1352 and 1350. Shield 1360 may further include tabs 1362. Tabs 1362 may fit in openings and electrically connect to ground traces or planes in a printed circuit board. Posts 1354 may be inserted in openings in a printed circuit board for alignment and mechanical stability.

Figure 14:
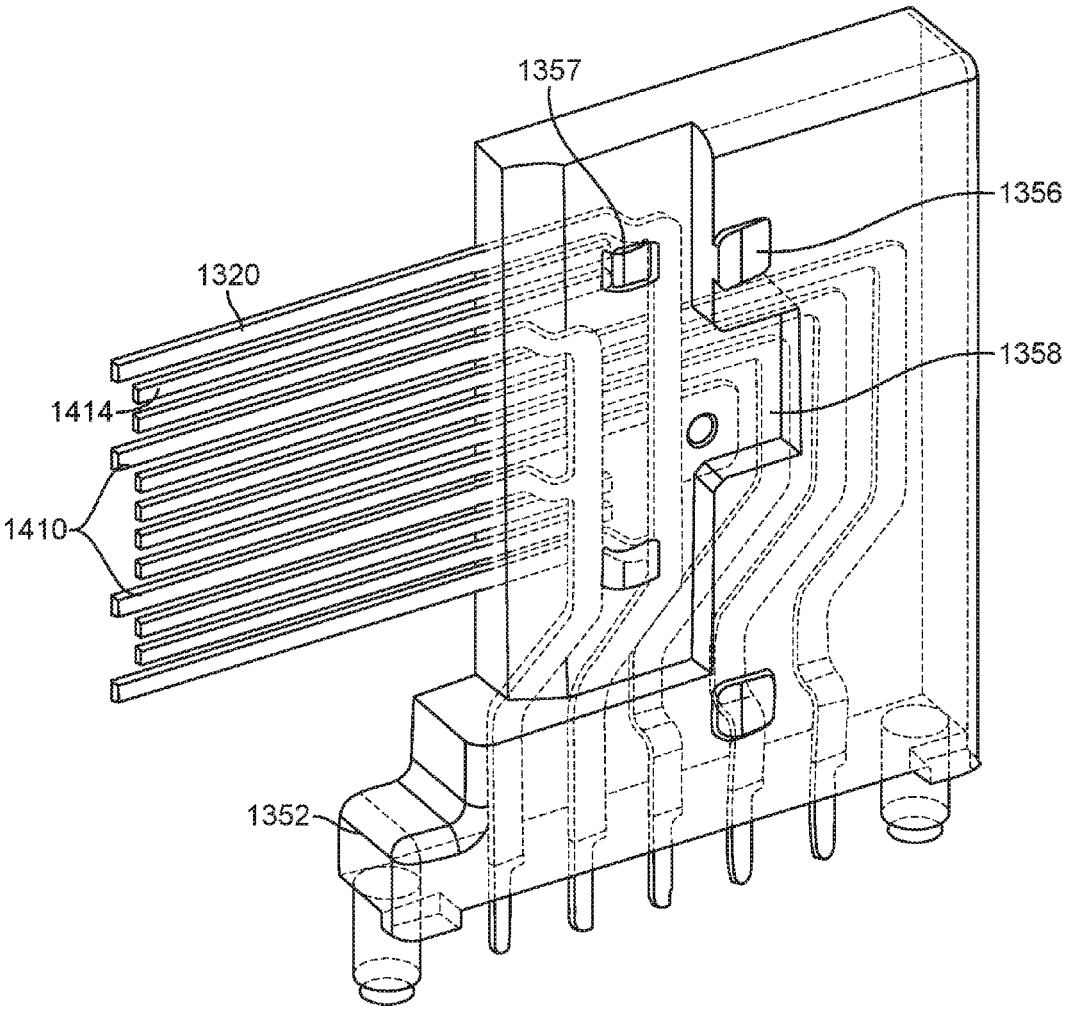
FIG. 14 illustrates a transparent view of two housing portions of the connecting structure of FIG. 13.
Figure 14:
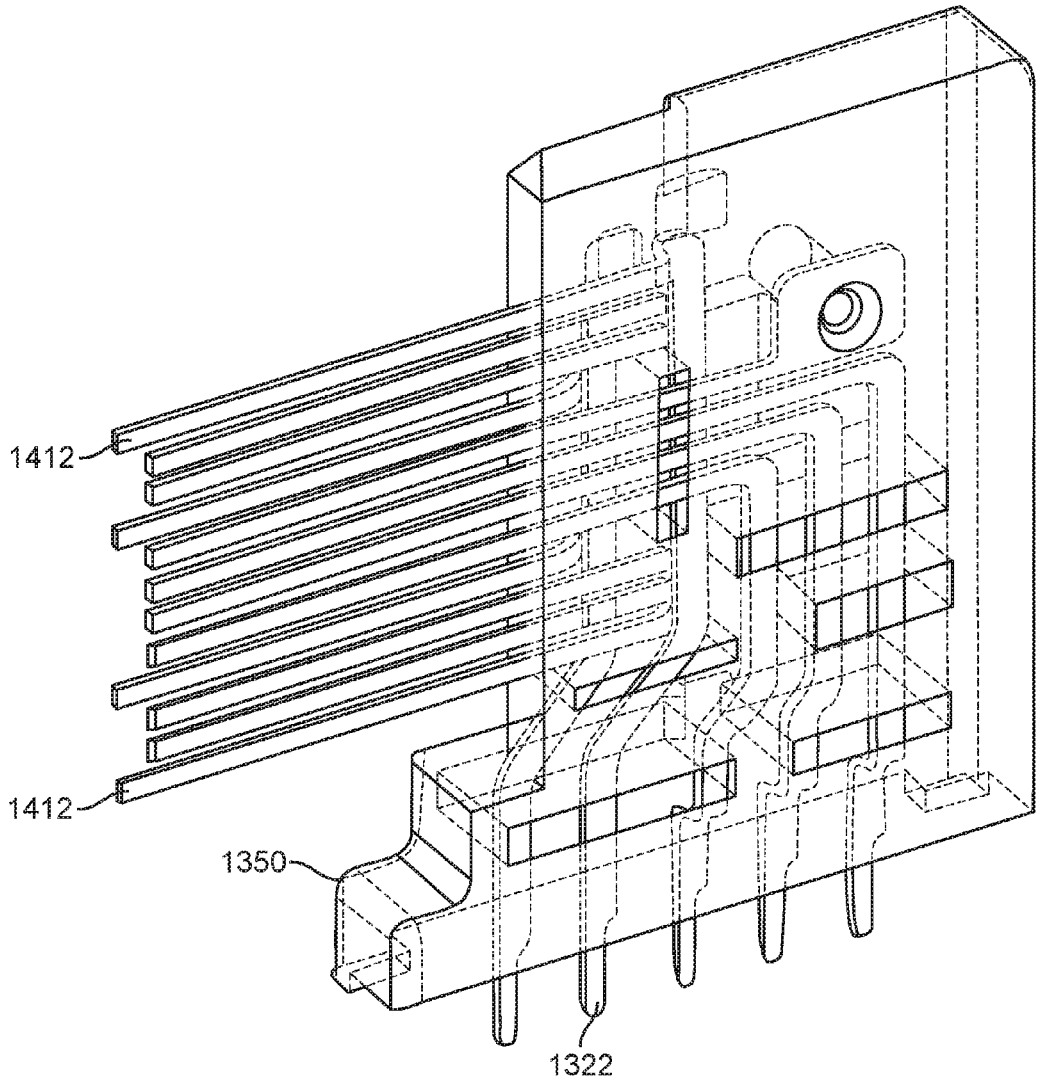

FIG. 14 illustrates contacts and housing portions of the connecting structure of FIG. 13. Housing portion 1352 and housing portion 1350 may each support a number of contacts 1320 that may terminate in board contact portions 1322. Contacts, or tongue contacting portions 1320, may be at least approximately orthogonal to board contacting portions 1322. In this way, contacts 1320 may provide a right angle translation between the tongue and a printed circuit board.

In various embodiments of the present invention, a number of contacts on a tongue may be fixed or determined by an existing interface specification. But it may be desirable to reduce the number of contact portions 1322. Reducing the number of board contact portions 1322 may reduce the board space consumed by connecting structure 1300. Accordingly, in some embodiments of the present invention, more than one tongue contacting portion 1320 may be connected together and connected to a single board contacting portion 1322. For example, tongue contact portions 1410 may electrically connected together. These contact portions may be for power and may connect together to a single power contact portion 1322. Similarly, ground contacts 1412 may be connected together to a single board contact portion 1322. Moreover, other tongue contacts, such as tongue contacting portion 1414, may be present but may not be connected to a board contacting portion 1322.

A third housing portion (not shown) may form tongue 1310. This third housing portion may attach to housing portions 1352 and 1350 using tabs 1357 and notches 1358, as shown below.

Figure 15:
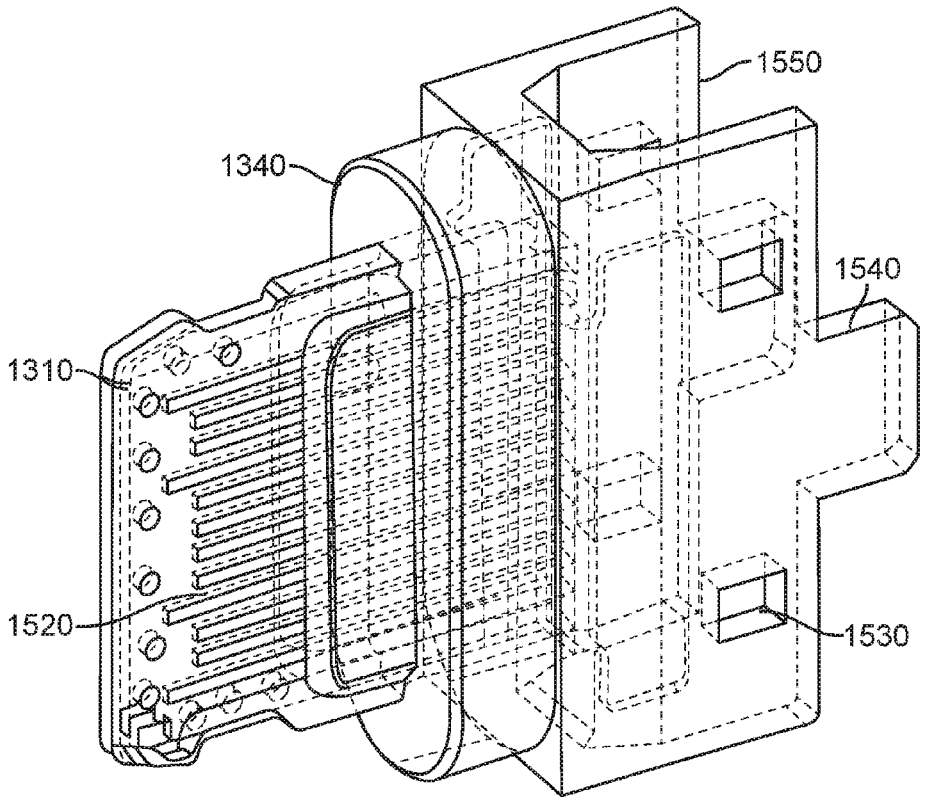
FIG. 15 illustrates a transparent view of another housing portion of the connecting structure of FIG. 13.

FIG. 15 illustrates a housing portion for the connecting structure of FIG. 13. Tongue 1310 may include a number of slots 1520. Tongue contact portions 1320 may reside in slots 1520. Raised portion 1340 may be formed on this housing portion. First and second housing portions 1350 and 1352 may be placed together and inserted into opening 1550. Tabs 1557 on housing portions 1352 and 1350 may fit in openings 1530, while extensions 1540 may fit in notches 1358 in housing portions 1352 and 1350.

In various embodiments of the present invention, contacts, shields, and other conductive portions of interposers and other connecting structures may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings and device enclosures, may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards and tongues used may be formed of FR-4, BT or other material. Printed circuit boards may be replaced by other substrates, such as flexible circuit boards, in many embodiments of the present invention.

Embodiments of the present invention may provide interposes and connecting structures that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These interposes and connecting structures may provide pathways for signals that are compliant with various standards such as Universal Serial Bus (USB) including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide interposes and connecting structures that may be used to provide a reduced set of functions for one or more of these standards. In various embodiments of the present invention, these interconnect paths provided by these interposes and connecting structures may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An electronic device comprising:

a device enclosure having a connector receptacle, the connector receptacle comprising:

a recess in the device enclosure, the recess having an opening near a rear of the recess; and a tongue including a plurality of contacts, the tongue emerging from the opening in the recess;

a printed circuit board supporting a plurality of traces; and an interposer to mechanically attach to the tongue and the printed circuit board and to form electrical connections between the plurality of contacts and the plurality of traces supported by the printed circuit board.

2. The electronic device of claim 1 wherein the connector receptacle consists of the tongue and the recess in the device enclosure.

3. The electronic device of claim 1 wherein the interposer comprises a plurality of contacts in a housing.

4. The electronic device of claim 1 wherein the tongue and the printed circuit board are at least approximately orthogonal to each other.

5. The electronic device of claim 4 wherein the tongue is formed of a second printed circuit board.

6. The electronic device of claim 5 wherein the interposer comprises a plurality of contacts each having a ninety degree bend and having a side portion extending beyond a first side of a housing and a bottom portion extending beyond a bottom of the housing.

7. The electronic device of claim 6 wherein the interposer further comprises a shield substantially over a top, second, third, and fourth sides of the housing.

8. An electronic device comprising:

a tongue for a connector receptacle, the tongue including a plurality of contacts;

a printed circuit board supporting a plurality of traces; and an interposer to mechanically attach to the tongue and the printed circuit board and to form electrical connections between the plurality of contacts and the plurality of traces supported by the printed circuit board, wherein the connector receptacle consists of the tongue and a recess in an enclosure of the electronic device.

9. The electronic device of claim 8 wherein the interposer comprises a plurality of contacts in a housing.

10. The electronic device of claim 8 wherein the tongue and the printed circuit board are at least approximately orthogonal to each other.

11. The electronic device of claim 10 wherein the tongue is formed of a second printed circuit board.

12. The electronic device of claim 11 wherein the interposer comprises a plurality of contacts each having a ninety degree bend and having a side portion extending beyond a first side of a housing and a bottom portion extending beyond a bottom of the housing.

13. The electronic device of claim 12 wherein the interposer further comprises a shield substantially over a top, second, third, and fourth sides of the housing.

14. An electronic device comprising:

a connecting structure comprising:

a first housing portion forming a tongue for a connector receptacle;

a second housing portion supporting a first plurality of contacts, the first plurality of contacts each including at least one tongue contacting portion at a first end to form a contact on a first side of the tongue and a board contacting portion at a second end; and a third housing portion supporting a second plurality of contacts, the second plurality of contacts each including at least one tongue contacting portion at a first end to form a contact on a second side of the tongue and a board contacting portion at a second end.

15. The electronic device of claim 14 further comprising:

a printed circuit board supporting a plurality of traces connected to openings, wherein the board contacting portions of the first and second plurality of contacts fit in the openings.

16. The electronic device of claim 15 wherein the tongue contacting portions of each of the first and second plurality of contacts is orthogonal to a corresponding board contacting portion.

17. The electronic device of claim 16 further comprising a shield around at least portions of the first housing, the second housing, and the third housing.

18. The electronic device of claim 14 wherein at least one of the plurality of first contacts and at least one or the plurality of second contacts each includes two tongue contacting portions and one board contacting portion.

19. The electronic device of claim 14 further comprising:

a printed circuit board supporting a plurality of traces connected to board contacts on the printed circuit board, wherein the board contacting portions of the first and second plurality of contacts are connected to the board contacts.

* * * * *